US005400525A

United States Patent [19]

Sheley

[11] Patent Number: 5,400,525

[45] Date of Patent: Mar. 28, 1995

[54] FLAME CONE FOR GRAIN BIN DRYER

[75] Inventor: Randall E. Sheley, Taylorville, Ill.

[73] Assignee: Grain Systems, Inc., Assumption, Ill.

[21] Appl. No.: 182,753

[22] Filed: Jan. 14, 1994

[51] Int. Cl.[6] ..... F26B 17/00

[52] U.S. Cl. ..... 34/360; 431/350; 34/576

[58] Field of Search ..... 431/350, 353, 348, ; 34/359, 360, 363, 507, 582, 576; 432/58

[56] References Cited

U.S. PATENT DOCUMENTS

| | | | |
|---|---|---|---|
| 6,550 | 6/1849 | Patten | 34/360 |
| 1,441,008 | 1/1923 | Lovett | 431/350 |
| 1,989,164 | 1/1935 | Beckwith | 431/350 |
| 2,250,304 | 7/1941 | Keating et al. | 431/350 |
| 2,754,895 | 7/1956 | Hershey | 431/350 |
| 3,280,473 | 10/1966 | Sullivan | 34/218 |
| 3,802,414 | 4/1974 | Lee | 126/595 |
| 4,790,744 | 12/1988 | Bellet et al. | 431/350 |
| 4,887,363 | 12/1989 | Burke | 34/57 A |

FOREIGN PATENT DOCUMENTS

| | | | |
|---|---|---|---|
| 1165169 | 9/1969 | United Kingdom | 431/350 |

*Primary Examiner*—Henry A. Bennett
*Assistant Examiner*—William C. Doerrler
*Attorney, Agent, or Firm*—Polster, Lieder, Woodruff & Lucchesi

[57] ABSTRACT

The flame cone of the present invention is intended to be used with a heater for a grain bin or the like. The heater comprises a housing having one or more housing walls and having an inlet end and an outlet end. A blower is provided for forcefully moving air from the inlet end through the housing and out of the outlet end. A burner is provided within the housing for heating air moving through the housing. A flame diverter is positioned within the housing downstream from the burner for diverting the flame outwardly from the burner toward the walls of the housing. The diverter comprises a cone-shaped structure having a plurality of spaced slats diverging outwardly from the burner and toward the walls of the housing. More specifically, the improvement of this invention comprises a burner cone having an apex and an outer base spaced axially from the apex with the slope of the burner cone being generally similar to the slope of the diverter. The apex of the burner cone is positioned proximate the burner on the inside thereof so that there is a gap between the inside faces of the diverter slats and the outer surface of the burner cone so as to provide a path for the burning fuel to travel from the burner outwardly toward the housing walls thereby to result in more efficient combustion of the fuel.

3 Claims, 2 Drawing Sheets

FLAME CONE FOR GRAIN BIN DRYER

BACKGROUND OF THE INVENTION

This invention relates to a heater for a grain bin or the like in which air is heated by a gas fired burner and then in ducted into a grain bin or other structure for drying or otherwise conditioning grain therein. Conventionally, such grain bin heaters include a housing which may be connected to a grain bin for directing heated air therefrom into the grain bin. A fan forcefully moves air through the housing, past a burner therein, and directs the heated air into the grain bin. Oftentimes the grain bin has a perforated floor raised above a concrete pad with the space between the floor and the concrete pad constituting a plenum chamber. The heater directs heated air under pressure into this plenum chamber where it is substantially uniformly distributed under the entire cross section of the grain bin such that the heated air may pass upwardly through the floor and through the grain supported on the floor so as to dry the grain.

Conventionally, most grain bin dryers are gas fired dryers which burn either liquefied petroleum (e.g., liquid propane) or natural gas. The dryer fan may be either an axially blower located upstream from the heater (as shown in FIGS. 2 and 3) and generally in axial alignment with the heater, or the fan may be a centrifugal fan (not illustrated) coupled to the heater upstream from the heater. Such heaters typically include a gas burner positioned within the central portion of the heater housing so that when the gas fuel is ignited, a flame is generated which heats the air forced by the fan through the heater housing and into the grain bin. It has been long known that by providing such gas fired grain bin heaters with a flame diverter that the flame can be more uniformly distributed within the housing thus resulting in better heating of the air being forced through the heater. Typically, such prior art flame diverters comprise a plurality of spaced slats arranged in a generally conical configuration with the apex of the conical diverter being positioned close to the burner at the center of the heater housing so as to direct the flame outwardly toward the walls of the housing. Typically, these flame diverter slats are provided with a multiplicity of holes therein so as to aid in supplying air to the air/fuel mixture.

In a gas burner, the gas fuel has a certain calorific value typically expressed in BTU/cubic foot of the gas fuel. For example, natural gas may have a calorific value of about 1,000 BTU/cu. ft., and commercially available propane L.P. gas may have a calorific value of about 2,350 BTU/cu. ft. If these gaseous fuels are completely combusted, the products of combustion will include carbon dioxide, water, and nitrogen compounds from the combustion air. Of course, such complete combustion insures the maximum release of heat from the fuel and results in the most efficient operation of the burner. Such complete combustion of the fuel results in the maximum amount of air being heated. Complete combustion of the fuel is usually visually evidenced by the flame burning with a bluish or colorless flame. If combustion is incomplete, as will be the case if there is not sufficient air for complete combustion, carbon monoxide and carbon with also make up part of the combustion products. It is well recognized that the presence of a "yellowish" flame is a sign that incomplete combustion (and thus less efficient combustion) is occurring such that the maximum efficiency of the burner is not being realized.

In many prior art grain dryer heaters such as above-described, it has long been noted that at least certain portions of the flame within the burner has had a generally yellowish appearance which is an indication of incomplete combustion. Typically, such areas of incomplete combustion were immediately downstream from the burner nozzle located at the center of the grain bin heater housing. However, with the known prior art grain burners it has not heretofore been possible to regulate the position of the flame within the heater housing so as to achieve both complete combustion and to divert the flame outwardly toward the walls of the housing so as to result in a more evenly distributed heating of the air. The above-described prior art flame diverters with their spaced slats did effectively direct the flames outwardly from the burner toward the walls of the housing, but such flame diverters (even when their spaced slats were provided with a multiplicity of holes therein) were not effective so as to insure that complete combustion of the gaseous fuel would result even if the burner was regulated to admit more air into the burner for mixing with the fuel prior to the point the fuel was ignited. As above-noted, in conventional prior art grain bin dryers (as shown in FIG. 2), a region of low pressure would develop immediately downstream from the burner nozzle such that when the fuel burned in this area, it would burn with a "yellowish" color flame generally indicative of incomplete combustion.

Thus, there has been a long-standing problem as to how to insure complete combustion for maximum efficiency of the heater and to simultaneously uniformly distribute the heated air with the air forcefully moved through the heater without duly restricting the flow of air through the blower/heater unit.

SUMMARY OF THE INVENTION

Among the several features and objects of the present invention may be noted the provision of a simple and low cost appliance that may be readily installed in conjunction with the prior art flame diverter for insuring that complete combustion of the fuel occurs with a visually apparent "blue" or colorless flame thereby to maximize the efficiency of the burner while simultaneously diverting the flame outwardly toward the walls of the heater housing so as to insure that the heated air is uniformly mixed with air flowing through the heater;

The provision of such an appliance which may be readily retro-fitted to existing heaters thereby to increase the efficiency of such existing heaters or which may be readily incorporated in new heaters;

The provision of such an appliance which is self-regulating in that it will work for its intended purpose over a wide range of fuel flow rates and air flow rates; and The provision of a method of burning a gaseous fuel in a heater in which it is insured that the combustion of such fuel results in substantially complete combustion, as visually evidenced by a "blue" or colorless flame.

Other objects and features of this invention will be in part apparent and in part pointed out hereinafter.

Briefly stated, the apparatus or appliance of the present invention is intended to be used with a heater for a grain bin or the like. The heater comprises a housing having one or more housing walls and having an inlet end and an outlet end. A blower is provided for forcefully moving air from the inlet end through the housing and out of the outlet end. A heater is provided within the housing intermediate the inlet and outlet ends. The heater comprises a burner for burning a fuel within the housing and for heating the air moving through the housing. A flame diverter is positioned within the housing downstream from the burner for diverting the flame outwardly from the burner toward the walls of the housing. The diverter comprises a cone-shaped structure diverging outwardly from the burner and toward the walls of the housing. The diverter has a plurality of spaced openings through which air may flow from the inlet to the outlet end of the housing. More specifically, the improvement of this invention comprises a flame cone having an apex and an outer base spaced axially from the apex with the flame cone cooperating with the diverter so as to facilitate the complete combustion of substantially all of the fuel. The apex of the flame cone is positioned proximate the burner downstream therefrom so that there is a gap between the inside face of the diverter and the outer surface of the flame cone thereby to insure that all of the fuel discharged from the burner is directed outwardly from the burner toward the housing walls so as to result in more complete combustion of all of the fuel.

The method of the present invention relates to the complete combustion of substantially all fuel (e.g., liquefied propane or natural gas) within a burner for a grain dryer or the like so as to maximize the amount of heat added to air flowing through a housing for being ducted into the grain bin for each unit mass of fuel combusted. The burner has a housing with an inlet end and an outlet end and housing walls. A fan is provided for forcefully moving air through the housing from the inlet end to the outlet end. A burner is positioned within the housing and is generally centrally located with respect to the housing walls and a generally. A flame diverter is positioned within the housing downstream from the burner for diverting the flame outwardly from the burner toward the walls of the housing. The diverter has a plurality of spaced openings for the flow of air through said housing from said inlet to said outlet end thereof. The improvement comprises the steps of forcefully moving air through the housing. Introducing fuel into the burner and igniting the fuel within said housing. At least partially confining the burning fuel within a gap formed between the inside face of the diverter and a flame cone which is generally coaxial with the flame diverter and positioned downstream from the flame diverter thereby to result in the flame burning with a blue color thus indicating that the fuel is being substantially completely combusted.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
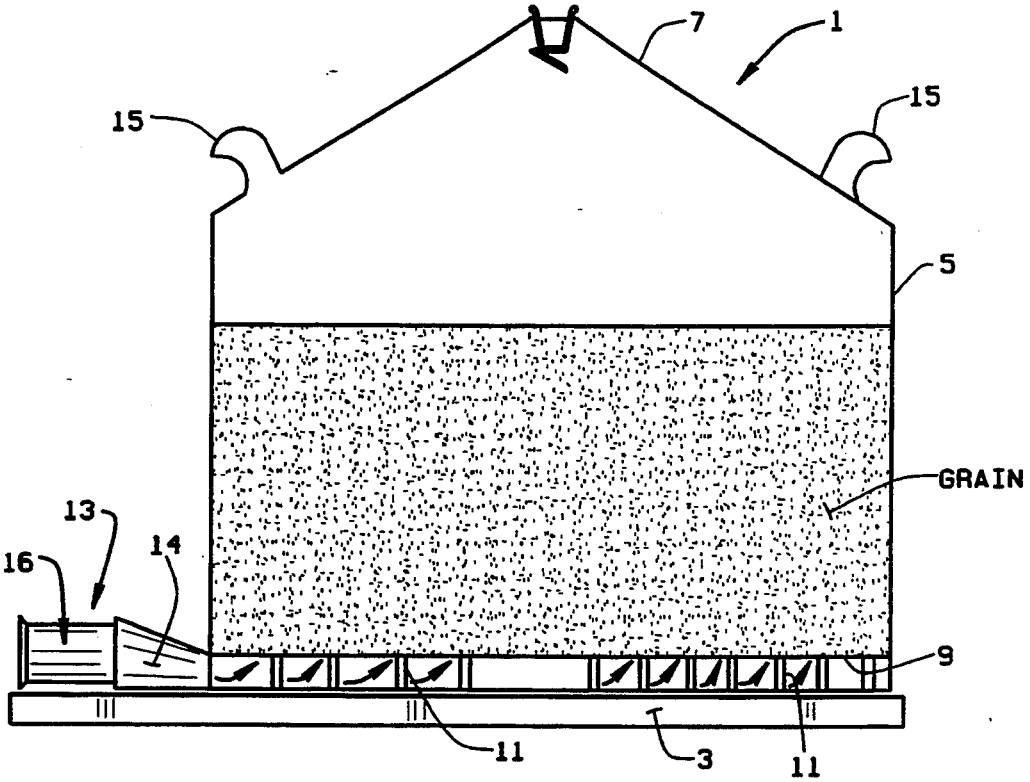
FIG. 1 is a cross sectional view of a grain bin illustrating a raised perforated floor, a heater and fan arrangement for introducing heated air under pressure into the plenum area beneath the grain bin floor so as to uniformly force heated air to rise through the grain within the bin supported by the raised floor.

Referring now to the drawings, a grain bin is indicated in its entirety at 1. The grain bin is installed on a concrete pad 3 and has side walls 5 which extend up from the pad. The grain bin has a conical-shaped roof 7. As is conventional, the grain bin is provided with a raised floor 9 of interlocking side-by-side channel floor members which are provided with a multiplicity of aeration holes (not shown). The grain bin floor is supported above the level of pad 3 by means of floor support legs 11 so as to provide a space between the grain bin floor 9 and the pad. This space serves as a plenum chamber for purposes as will appear.

As indicated at 13, a combination blower/heater unit is provided for supplying heated air via a transition 14 under pressure to the plenum chamber so that the heated air is substantially uniformly distributed under floor 9 such that the heated air will pass through the perforations in the floor members and pass through the grain supported by the floor to dry the grain. The roof of grain bin 1 is provided with a plurality of roof vents 15 for venting air from within the grain bin after the heated air has passed through the grain thereby to discharge moisture from within the grain bin.

Figure 2:
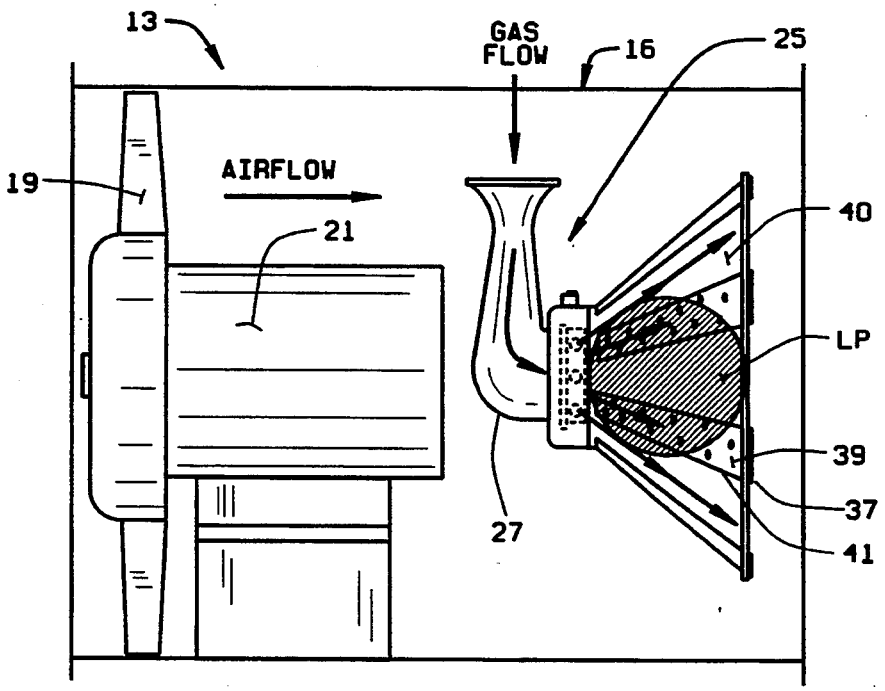
FIG. 2 PRIOR ART
FIG. 2 is a view of a prior art axial fan/gas fired heater for introducing heated air into a grain bin or the like illustrating a prior art flame diverter and the area in which incomplete combustion of the gas fuel typically occurs, as evidenced by a yellowish appearing flame, thus indicating incomplete combustion of the fuel.
Figure 3:
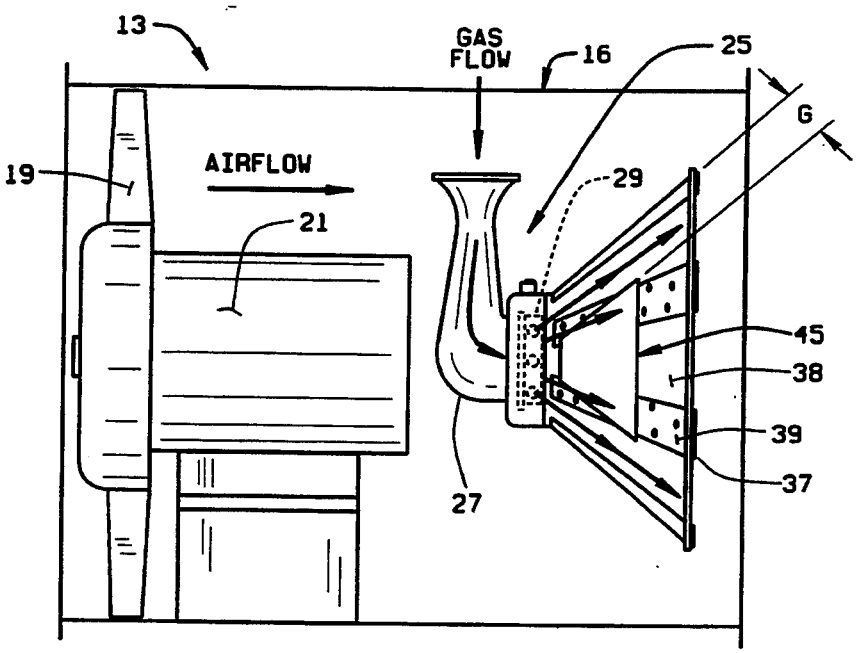
FIG. 3 is a view of an axial fan/gas fired heater similar to that shown in FIG. 2, but having a burner cone of the present invention installed therein downstream from the flame diverter thereby to result in the substantially complete combustion of the fuel such that the resulting flame has a blue or colorless appearance.

As shown in FIGS. 2 and 3, the blower/heater 13 has a housing 16 having a generally cylindrical housing wall 17 enclosing an axial fan 19 powered by an electric motor 21 for forcefully moving air though the housing from an inlet end thereof (i.e., the left end on the housing as shown in FIG. 2) to the outlet end and into a transition section 23 between housing 15 and the grain bin wall 5 such that the heated air is introduced into the plenum space beneath floor 9. While the fan of blower/heater unit 13 is herein illustrated to be an axial fan, it will be understood that oftentimes, larger such blower/heater units incorporate a centrifugal blower in place of the above-described axial blower. Within the broader scope of this invention, the term blower/heater or blower includes any type of an air moving fan, blower, or the like. In addition, the blower/heater 13 includes a burner, as generally indicated at 25, located centrally within housing 15 (i.e., located generally on the axial centerline of the housing) downstream from fan 19.

Figure 4:
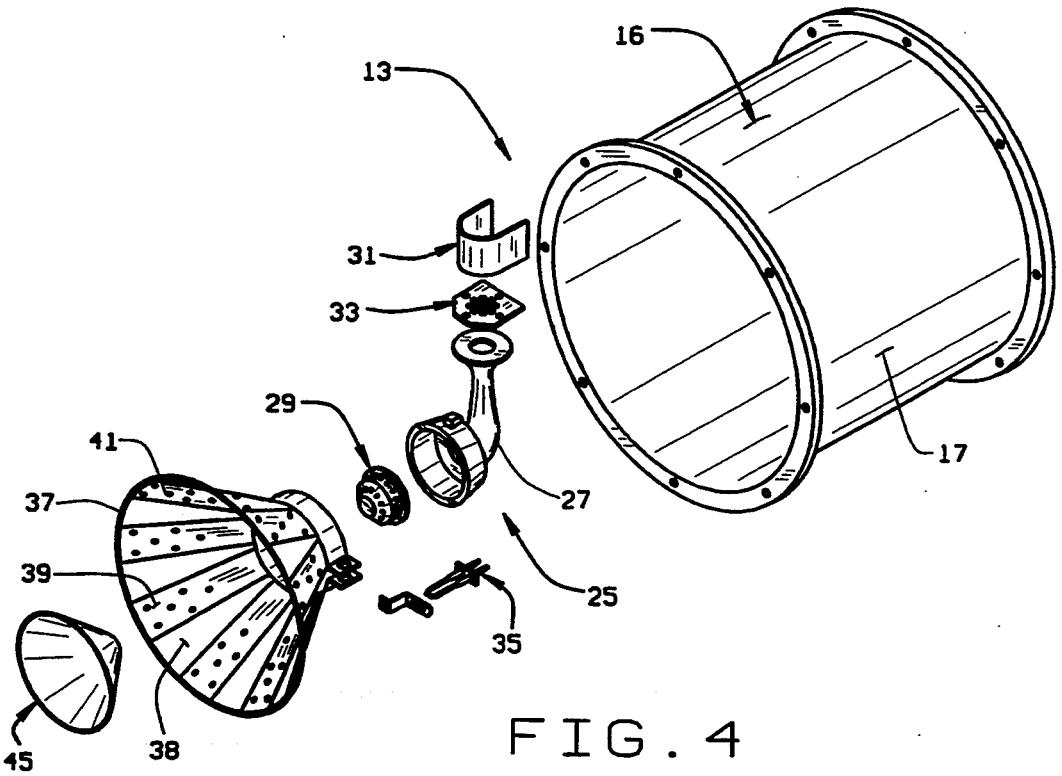
FIG. 4 is an exploded perspective view of the heater and burner illustrating the prior art components including a flame diverter having a plurality of radially spaced slats and further illustrating the provision of a burner cone of the present invention which is installed in the heater housing downstream from the flame diverter so as to provide a gap between the inside faces of the flame diverter slats and the outer face of the burner cone so as to at least partially confine the air/fuel mixture as it burns thereby to result in substantially complete combustion of the fuel.

More specifically, burner 25 includes a right angle burner housing 27 which extends downwardly from the blower housing 15 and which has a burner flame spreader or nozzle 29 on the end of the burner housing with the nozzle positioned generally on the axial centerline of housing 16. A vaporized fuel, such as liquefied natural gas or propane, is supplied to burner 25 by means of fuel lines or the like. As is conventional, a liquid fuel vaporizer (not shown, but typically a coil of tubing carrying the liquid propane to burner 25) is located centrally within housing 15 downstream from the burner for being heated by the flame and heated air from the burner for evaporating the liquid propane prior to its being discharged into the air flowing through the burner housing so as to mix the vaporized fuel with air prior to ignition of the resulting air/fuel mixture outside the burner. As shown in FIG. 4, the vaporized fuel from the vaporizer is directed downwardly to burner housing behind a collector 31 and through a perforated collector plate 33 and into the upper end of burner housing 27. It will be appreciated that the vaporized fuel is mixed with combustion air as it encounters the collector and collector plate such that an air/fuel mixture is drawn through the burner housing and vented through the flame openings or hole provided in nozzle 29. An igniter or spark plug 35 is provided adjacent but downstream from the burner nozzle so as to ignite the air/fuel mixture discharged from the burner at a location generally centered within housing 15.

A generally conical-shaped flame diverter 37 is attached to the burner on the downstream side thereof. This flame diverter 37 is made up of a plurality of radially spaced slats 39 which diverge radially outwardly and angle downstream from the burner for diverting the flame formed at the burner nozzle outwardly toward the wall 17 of housing 15. Flame diverter 37 has a plurality of openings 40 between spaced slats 39 through which the air moving through housing 15 must pass. As is indicated at 41, each of the diverter slats 39 has a multiplicity of holes therethrough for admitting air through the slats so as to help insure that the combusting air/fuel mixture emitted from nozzle 29 has excess air for insuring complete combustion of the fuel. Of course, with fan 19 in operation and with fuel emitted from nozzle 29 being ignited within the housing, the air moving through the housing will thus be heated.

While flame diverter 37 has been described as comprising a plurality of spaced slats 37 with spaced openings 40 therebetween, it will be understood that within the broader context of this invention, flame diverters of other configurations may be used. For example, a flame diverter (not herein illustrated) may be a conical-shaped structure of sheet metal construction or the like having a plurality of air passage openings therein with the air passage openings being of sufficient cross sectional area to permit air forcefully moved by blower 19 to pass through housing 15 without undue restriction. In addition, smaller combustion air holes (like holes 41 in diverter slats 39) may be provided.

As indicated in FIG. 4, the blower/heater unit 15 as above-described is conventional and is prior art relative to the improvement of the present invention. Such prior art blower/heaters, while they did work well for their intended function, were observed to burn the fuel in an incomplete manner, as evidenced by a yellowish colored flame which was present within housing 15 downstream from burner nozzle 29 and downstream from flame diverter 37. As indicated at 43 in FIG. 2, a region of low pressure LP has been found in many prior art heater burners in which combustion occurs. It is believed that this low pressure area results in incomplete combustion of the air/fuel mixture.

In accordance with this invention, a flame cone, as is indicated in its entirety at 45, is installed within flame diverter 37 downstream from burner nozzle 29 on the inside of the conical-shaped flame diverter. More particularly, flame cone 45 is preferably (but not necessarily) a cone-shaped member having a slope or conical angle generally the same as the slope of the conical-shaped flame diverter. The apex of flame cone 45 is preferably positioned as close as possible to (even abutting) flame nozzle 29 such that a gap G, ranging between about 1 inches and about 6, and more preferably ranging between about 1½ to about 3½ inches, is formed between the inside faces of the flame diverter 37 and the outer face of the flame cone 45.

In operation, with flame cone 45 installed within flame diverter 37 as above-described and with gaseous fuel being delivered to burner 25 and with blower 19 forcefully moving air through housing 15 from its inlet end past burner 25 to its outlet end, an air/fuel mixture is emitted from the flame holes in burner nozzle 29 into gap G between the inner face of flame diverter 37 and the outer face of flame cone 45 where the air/fuel mixture is ignited by igniter 35. The resulting combusting air/fuel mixture is forced by the air moving through the housing and by being forcefully ejected from the flame holes of the burner nozzle to move in a divergent fashion radially outwardly and downstream within the gap G formed between the inner faces of flame diverter slats 39 and the outer face of flame cone 45. By placing flame cone 45 of the present invention on the downstream side of the flame diverter 37 in the region of normally low pressure, as indicated at LP in FIG. 2, the combusting air/fuel mixture is diverted from this low pressure region where incomplete combustion has in the past been noted and is at least partially confined between the inner faces of flame diverter 37 and the outer face of the flame cone such that excess air forced through openings 41 in diverter slats 39 and excess air flowing around the slats is mixed with the combusting air/fuel mixture thereby to result in complete combustion of the air/fuel mixture. As a result of the flame cone 45 of the present invention, substantially the entire quantity of the air/fuel mixture burns with a colorless or "blue" flame is visually indicative of complete combustion of the fuel. Of course, such complete combustion results in the maximum amount of heat being released from the fuel such that the efficiency of the burner is maximized and such that the maximum volume of air is heated the greatest amount. In addition, as the air flowing through housing 15 encounters flame diverter 37 and flame cone 45, the air and the flames are intermixed and are forced to spread radially outwardly toward the walls 17 of the housing.

It will be appreciated that the diameter of the downstream end (i.e., the enlarged end) of flame cone 45 is such that the flame cone does not unduly restrict or interfere with the flow of air through the housing. It is noted that the flame cone is installed in housing 16 at the center thereof in it is located in close proximity to burner nozzle 29 and is in axial alignment with motor 21 such that the motor and the nozzle serve to at least partially block the flow of air in the center portion of the housing which may in part result in the above-noted low pressure area. As the air moves past the downstream end of flame cone 45, the air is caused to mix turbulently with the products of combustion of the flame thus more uniformly mixing the heated air with the airstream moving though the housing. This results in the entire airstream exhausted from housing 15 being uniformly heated to a higher temperature and thus eliminates wide variations in temperature in the heated air. Thus, a larger volume of air heated uniformly to a higher temperature is available for discharge into the grain bin per unit volume of fuel consumed than when the flame cone 45 of the present invention is not used.

In view of the foregoing, it will be seen that the several objects of the invention are achieved and other advantageous results are obtained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. In heater for a grain bin or the like comprising a housing having an inlet end and an outlet end, said housing having one or more housing walls, a blower for forcefully moving air from said inlet end through said housing and out of said outlet end, a heater within said housing intermediate said inlet and outlet ends, said heater comprising a burner for burning a fuel within said housing and for heating said air moving through said housing, a flame diverter within said housing downstream from said burner for diverting said flame outwardly from said burner toward the walls of said housing, said diverter comprising a cone-shaped structure diverging outwardly from said burner and toward the walls of said housing, said diverter having a plurality of spaced openings therein for permitting of air moved by said blower to pass therethrough, wherein the improvement comprises: a flame cone having an apex and an outer base spaced axially from said apex with the slope of said flame cone being generally similar to the slope of said diverter, said apex of said flame cone being positioned proximate said burner on the inside of said diverter so that there is a gap between the inside face of said diverter and the outer surface of said flame cone so as to provide a path for the burning fuel to travel from said burner outwardly toward said housing walls thereby to result in more complete combustion of said fuel.

2. In a heater as set forth in claim 1 wherein said gap between the inside faces of said diverter and the outside face of said burner cone ranges between about 1 inch and about 6 inches.

3. A method of combusting fuel within a burner for a grain dryer or the like so as to maximize the amount of heat added to air flowing through a housing for being ducted into said grain bin for each unit mass of fuel combusted, said burner having a housing with an inlet end and an outlet end, said housing having housing walls, a fan for forcefully moving air through said housing from said inlet end to said outlet end, a burner within said housing positioned centrally with respect to said housing walls, and a generally cone-shaped flame diverter positioned within said housing downstream from said burner for diverting said flame outwardly from said burner toward the walls of said housing, said diverter diverging outwardly from said burner and toward said housing walls, wherein the improvement comprises the steps of:

forcefully moving air through said housing;

introducing fuel into said burner and igniting said fuel within said housing; and at least partially confining said burning fuel within said housing into a gap formed between the inside face of said diverter and a flame cone generally coaxial with said flame diverter and positioned downstream from said flame diverter thereby to result in said flame burning with a blue color thus indicating that said fuel is being substantially completely combusted.

* * * * *